US005326314A

United States Patent [19]

Brockway et al.

[11] Patent Number: 5,326,314

[45] Date of Patent: Jul. 5, 1994

[54] METHOD AND SYSTEM OF CLEANING INDUSTRIAL AIR

[75] Inventors: James M. Brockway; Mark J. Brockway; Terry M. Brockway, all of Burlington, Iowa

[73] Assignee: Brockway Mechanical and Roofing Company, Inc., Burlington, Iowa

[21] Appl. No.: 21,771

[22] Filed: Feb. 24, 1993

[51] Int. Cl.[5] ..... F24F 7/08

[52] U.S. Cl. ..... 454/66; 454/67; 454/252

[58] Field of Search ..... 454/49, 66, 67, 239, 454/252

[56] References Cited

U.S. PATENT DOCUMENTS

| | | | |
|---|---|---|---|
| 2,593,702 | 4/1952 | Schneible | 454/66 |
| 3,834,293 | 9/1974 | Danieli . | |
| 3,994,210 | 11/1976 | Davis | 454/66 |
| 4,091,719 | 5/1978 | Galloway . | |
| 4,255,169 | 3/1981 | Leliaert et al. . | |
| 4,779,671 | 10/1988 | Dolison . | |
| 5,083,918 | 1/1992 | Potter et al. . | |

FOREIGN PATENT DOCUMENTS

| | | | |
|---|---|---|---|
| 34041 | 4/1981 | Japan | 454/66 |
| 280339 | 12/1986 | Japan | 454/67 |
| 282743 | 12/1986 | Japan | 454/67 |
| 18749 | of 1909 | United Kingdom | 454/66 |

*Primary Examiner*—Harold Joyce
*Attorney, Agent, or Firm*—Henderson & Sturm

[57] ABSTRACT

A system and method for efficiently and economically providing a sufficient number of air changes per hour to satisfy government recommended standards for proper ventilation of industrial manufacturing facilities. The system is applicable to a building, housing manufacturing facilities and forms an enclosure within the building including the ceiling, floor and certain walls. The ventilation system may include an air-impervious curtain attached to the ceiling and to one or more walls, with a lower edge spaced above the floor to form the enclosure; and includes further an air supply assembly including ceiling mounted fans, vertical and horizontal ductwork for forcing outside unconditioned air into the enclosure at appropriate air flow rates and through a discharge slot formed in the horizontal ductwork at a level spaced above the floor, generally equal the height of the curtain lower edge above the floor; air heating units mounted within the building for forcing heated air from exterior the building into the enclosure; a plurality of ceiling mounted fans for withdrawing air trapped within the enclosure and exhausting it into the atmosphere; and a control unit for controlling the air supply assembly, the air heating units and the air exhaust fans for effecting a predetermined number of air changes within the enclosure.

15 Claims, 2 Drawing Sheets

METHOD AND SYSTEM OF CLEANING INDUSTRIAL AIR

TECHNICAL FIELD

This invention relates to a method and system for cleaning air, and more particularly to forming an enclosure within an industrial building and cleaning the air within the enclosure according to certain standards.

BACKGROUND ART

The prior art is replete with ventilating systems designed for operation in an effective, efficient manner to condition the air within a given building structure. The problem is exacerbated when the air to be conditioned exists within buildings of varying size and wherein industrial machinery is used. Industries, such as foundries, for example, and fabrication or welding plants use machinery which produces contaminated air which may pose a health hazard to the workers within the industrial areas.

Although various methods and systems have been devised for cleaning industrial air, such as filters, dust collectors, electrical precipitators, water wash and the like, there is still a need in the industry for an effective, efficient system to meet contemporary government O.S.H.A. PEL (Permissible Exposure Levels) requirements.

The problem is further compounded by the present cost of heat. Certain present day systems appear to achieve the PEL requirements, however, require abnormally high energy, (heating) costs, particularly for the make-up air, thus rendering those systems cost ineffective. It is to the provision of a method and system of cleaning air within a given industrial area to comply with industry standards and to achieve a marked energy saving that the present invention is directed.

DISCLOSURE OF THE INVENTION

The air cleaning system and method of this invention is applicable to a building having a ceiling, a floor and a plurality of angularly related walls joining the floor and ceiling to form a room, with industrial equipment normally operating in the room. An enclosure within which to clean the air is formed within the room by an air duct extended horizontally about the room above the floor. Should the area to be air-cleaned be smaller than the room, a vertically disposed air-impervious curtain is dropped from the ceiling to the air duct, with opposed ends of the curtain placed contiguous with respective walls to form an enclosure smaller than the room. Outside air is supplied to the air duct by a plurality of roof mounted fans directly above the ceiling of the enclosure, with vertical supply ducts extended between the fans and the air duct for forcing air into the air duct. The outside air is then forced into the enclosure at a predetermined air flow rate through an elongated slot formed in the air duct. The direction of the air flow may vary from horizontal to within an upwardly directed arcuate zone.

The system and method includes further air heating units mounted on one of the walls for forcing outside, heated air into the enclosure by deflection on the floor if necessary; a plurality of roof mounted exhaust fans for exhausting air within the enclosure to outside the building, and a control unit for controlling the operation of the air supply fans, air heating units and air exhaust fans to effect a predetermined number of air changes per unit of time within the enclosure.

It is, therefore, an object of this invention to provide a method and system of ventilation for an industrial manufacturing area which fulfills current Clean Air requirements in an effective and efficient manner.

It is another object of this invention to provide such a clean air system which utilizes the environment of the industrial manufacturing area to the utmost.

Another object of the present invention is to provide such a clean air system while disrupting the manufacturing and personnel use of the area at a minimum.

Yet another object of the present invention is to provide such a clean air system while markedly reducing heating requirements.

Still another object of the invention is to provide such a clean air system capable of providing a minimum of eighty percent (80%) of its own make-up air requirements without having to condition the supply air prior to bringing it into the building, thus providing vast savings in the amount of energy required.

Another object of the present invention is to provide such a clean air system which makes it affordable to have excellent indoor air quality for workers in the manufacturing environment.

Other objects, advantages, and novel features of the present invention will become apparent from the following detailed description of the invention when considered in conjunction with the accompanying drawings.

BRIEF DESCRIPTION OF THE DRAWINGS

These and other attributes of the invention will become more clear upon making a thorough review and study of the following description of a preferred embodiment, particularly when reviewed in conjunction with the drawings, wherein.

BEST MODE FOR CARRYING OUT THE INVENTION

Figure 1:
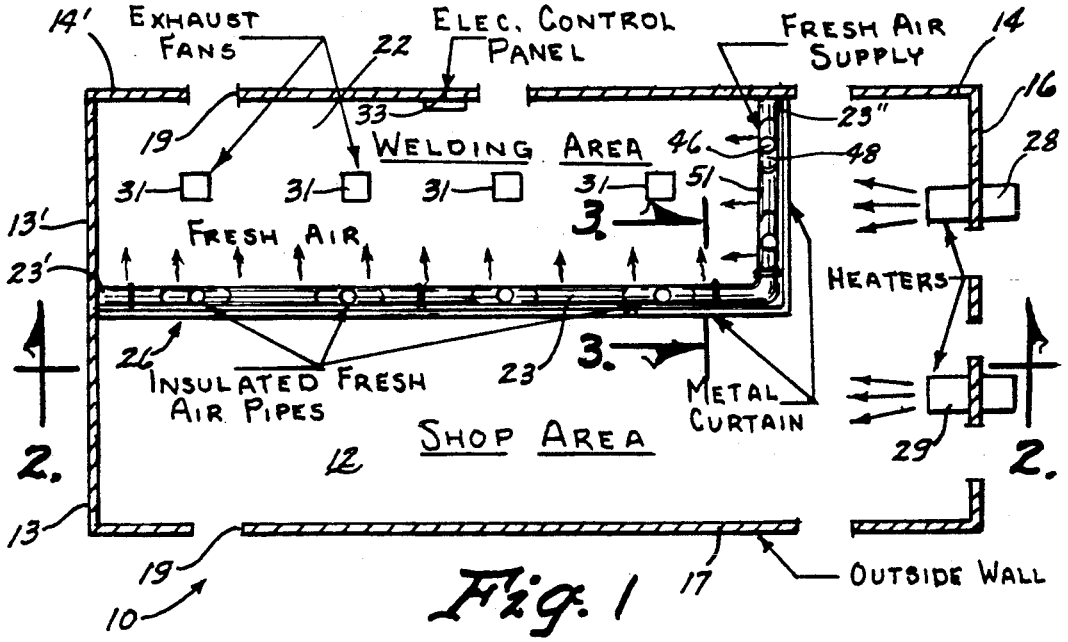
FIG. 1 is a plan view of a building and showing in partial schematic the components of the invention.
Figure 2:
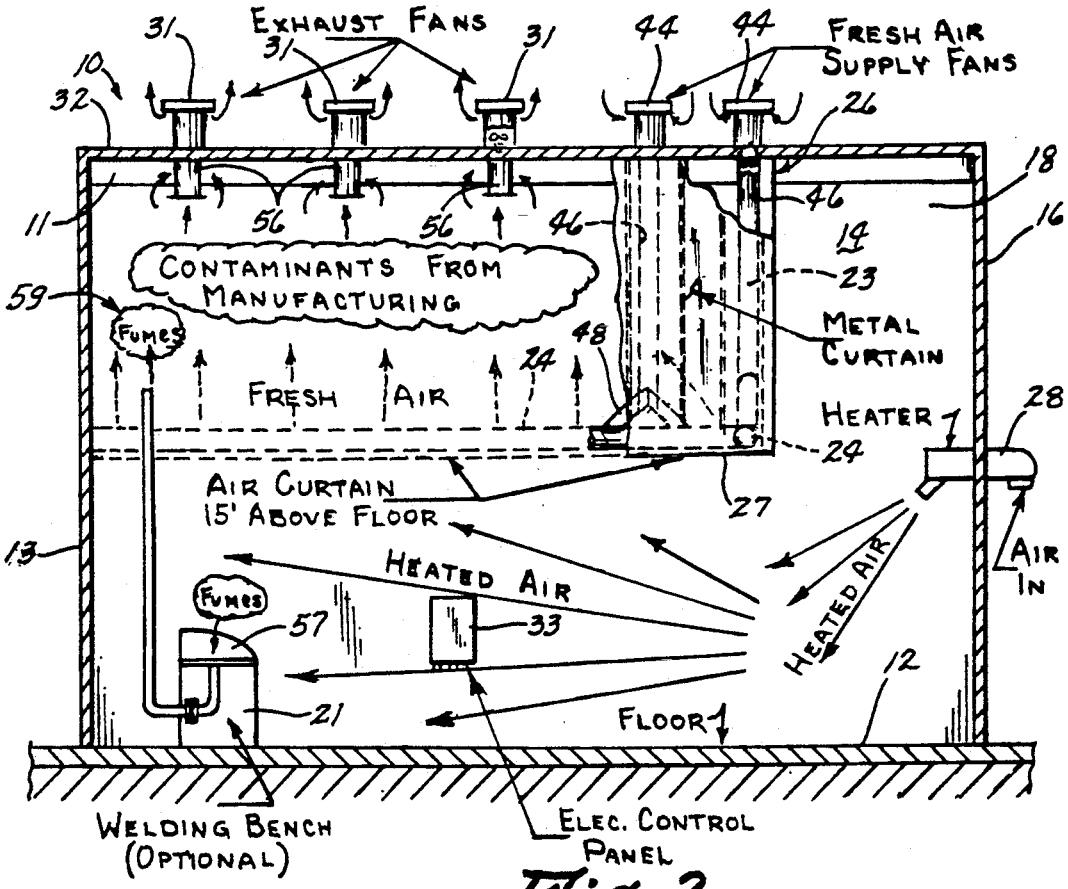
FIG. 2 is an elevational view taken as indicated along the line 2—2 in FIG. 1, with certain parts broken away and others shown in dashed lines for clarification of the illustration.

Referring to FIGS. 1 and 2, the system for practicing this method is illustrated. The area to have the air cleansed therein comprises a building (10) having a normally flat ceiling (11), a floor (12), and a plurality of walls—in this instance four walls (13), (14), (16) and (17), angularly related to form a rectangular room (18). A plurality of door openings (19) are shown in FIG. 1, however these are normally closed by appropriate doors (not shown) forming fairly air-tight closures. Not shown are conventional manufacturing machines for industrial use, manned by personnel, except for a welding bench (21) discussed hereinafter.

An enclosure (22) is formed within the room (18) of a smaller area as defined by an air curtain (23) and an air duct (24), the latter part of an air supply unit (26) for withdrawing air from external the building (10), for transmitting the external air into the air duct (24) and thence into the enclosure (22) at a height generally equal the height of the curtain lower edge (27) (FIG. 2), which edge (27) is spaced at a predetermined height off the floor (12) to provide for movement throughout the entire room (18) of personnel and conventional moving equipment such as lift trucks and the like.

Heated air is supplied to the enclosure (22) by a pair of direct fired heater units (28), (29) mounted on one of the walls (16) for example, and capable of withdrawing air from external the building (10), heating it and then forcing it into the room (18) for entry, as by deflection off the floor (12) in this instance, into the enclosure (22) to form a zone below the air duct (24) of tempered air. Untempered (unheated) and contaminated air gathered in an upper zone above the air duct (24) is withdrawn into the atmosphere in this instance by a plurality of exhaust fans (31) mounted on the building roof (32) directly above the ceiling (11) and centrally of the enclosure (22) as best shown in FIG. 1.

The clean air system of this invention is completed by a control panel (33) mounted in this instance on one of the walls (14) for example, and capable with known technology of controlling the operation of the air supply unit (26), the air heating units (28), (29), and the air exhaust fans (31) in a manner sufficient to effect a predetermined, ten in this instance, of air changes per hour within the enclosure (22).

Figure 3:
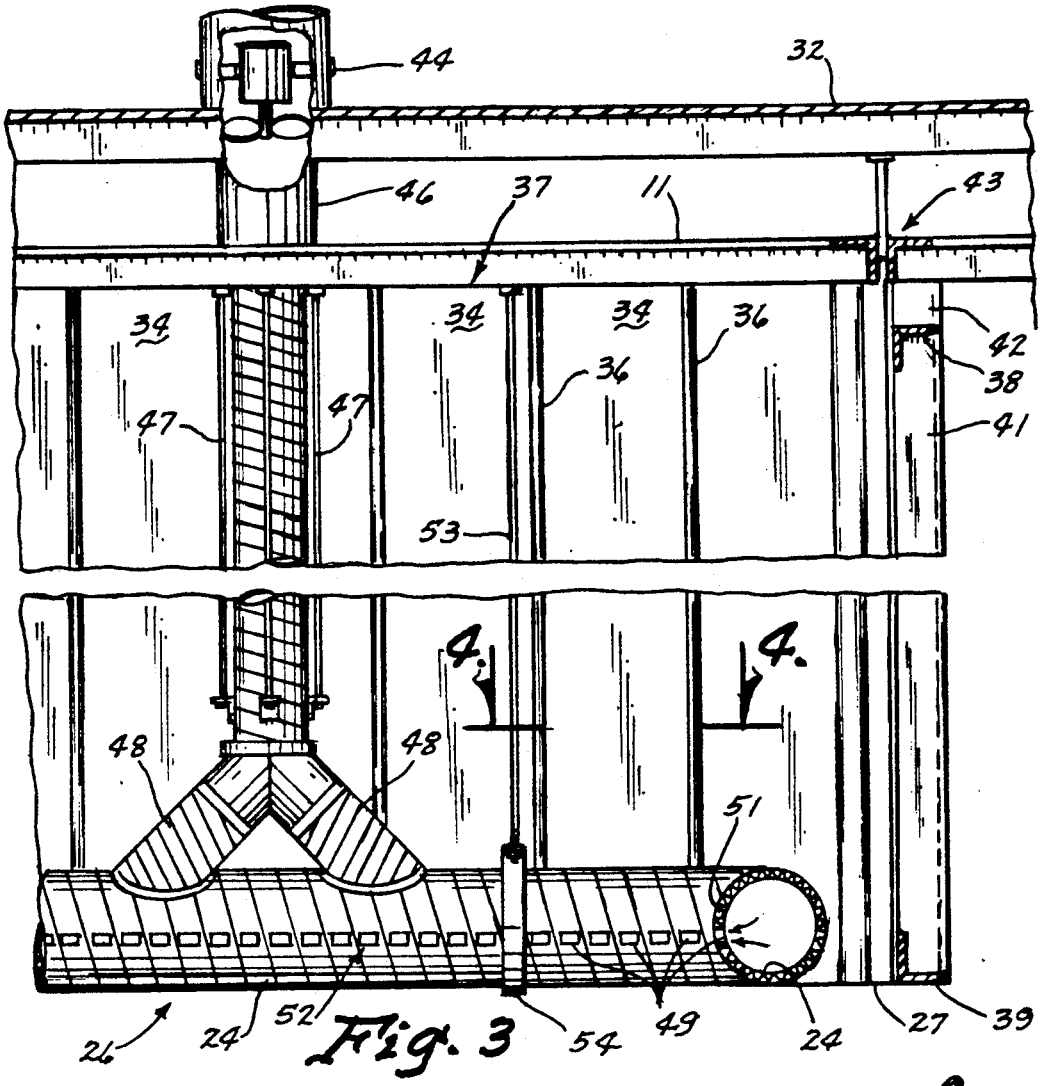
FIG. 3 is an enlarged vertical elevational view of the curtain panel and associated parts at an interior corner as taken along the line 3—3 in FIG. 1.
Figure 4:
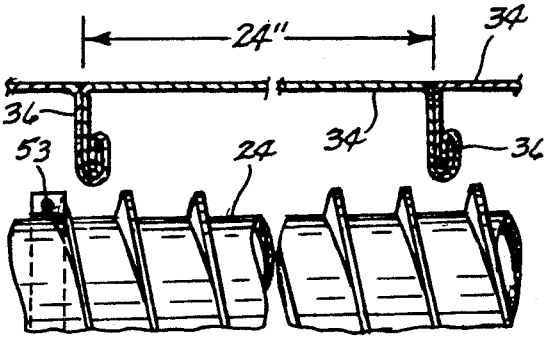
FIG. 4 is a fragmentary elevational view as taken along the line 4—4 in FIG. 3.
Figure 5:
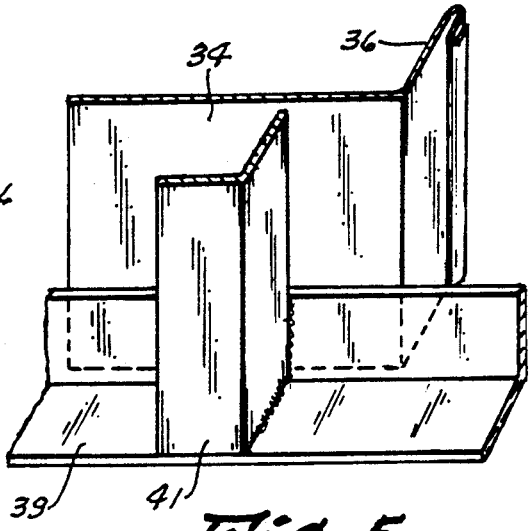
FIG. 5 is an enlarged detail view of the base of the air curtain panel.

More particularly, the air curtain (23) comprises a plurality of light gauge metal panes (34) (FIGS. 4 and 5) with ribs (36) seamed together to form a solid, air-impervious panel (37). The panel (37) is supported by a pair of vertically spaced angle irons (38), (39), one at the lower edge (27) of the curtain (23), and which angle irons extend horizontally the entire length of the curtain (23). At horizontally spaced intervals, vertically disposed angle irons (41) are secured as by welding to the angle irons (38), (39), with the upper ends (42) (FIG. 3) of the vertical angle irons (41) secured to bar joints (43) for the roof (32).

In the present instance, as an enclosure (22) smaller than the room (18) is the given area for cleaning industrial air therein, the air curtain (23) is formed in an L-shape (see FIG. 1) to form in turn the enclosure (22) with portions (13') and (14') of the walls (13), (14), this being accomplished by opposite ends (23') and (23") of the curtain placed in a contiguous, substantially air-tight relationship with the respective walls (13), (14). It is further envisaged that an air enclosure may of necessity require an air curtain with its opposite ends placed contiguous with each other such that building walls are not available for use, and it is further envisaged that an entire room, such as (18) may need to have the air cleaned, the present system adaptable to utilize the four walls in place of the air curtain, thus obviating in that instance the need of the air curtain (23).

Where the curtain is used, as in the present embodiment, its lower edge (27) is placed laterally adjacent the air duct (24) (see FIG. 3) whereby to form the enclosure (22) that extends within the room (18) above the air duct (24) and in conjunction with the wall portions (13') and (14'). As the air duct (24) is placed within the range of ten to twenty feet above the floor (12), fifteen feet in this instance, the lower curtain edge (27) is also placed at that height (fifteen feet) above the floor.

The air supply unit (26) comprises in particular a plurality of fresh air supply fan units (44) (FIG. 3) each mounted on the roof (32) for introducing unconditioned air into the enclosure (22), the fan units (44) being fluid connected with vertical air ducts (46) suspended from the roof and through the ceiling (11) by hangers (47), and fluid connected at their base ends by a Y-split air duct (48) to force fresh air into the horizontal air duct (24). To provide for directing the outside air into the enclosure in a generally horizontal direction, a plurality of openings (49) (FIG. 3) are formed in that portion (51) of the duct (24) which faces inwardly of the enclosure (22), the openings (49) extending generally horizontally along the air duct (24) and thus forming in effect a horizontally extended slot (52) through which fresh air is forced. By either forming the openings (49) slightly higher on the face (51) of the air duct (24), by installing the duct (24) in a rotated condition so as to locate the present openings (49) higher, by vertically elongating the openings (49), or by providing air deflecting flanges (not shown) on the air duct (24), the direction of air forced out of the slot (52) into the enclosure (22) may range within a sixty degree (60°) arc upwardly from a horizontal base. The air duct (24) is supported from the roof bar joists (43) by rod hangers (53) (FIG. 3) and band iron hangers (54).

The heater units (28), (29) are placed such as to obviate directing heated air into personnel, are located also at a height similar to that of the air duct (24) (see FIG. 2) and provide for directing heated air from outside the building (10) downwardly at an approximate forth-five degree angle. This arrangement normally results in the heated air being deflected of the floor (12) into the area of the enclosure (22).

Referring to FIGS. 1 and 2, the exhaust fans (31) are shown, four in this instance, located centrally of the enclosure (22) and with intake ducts (56) extended into the upper area of the enclosure for withdrawing air therefrom and exhausting it into the atmosphere. As mentioned hereinbefore, the control panel (33) utilizes state-of-the air circuitry, operating all year round, including the heater units (28), (29) and utilizing appropriately located sensors (not shown) to monitor all variables appropriate to controlling the system.

The method of cleaning air within the present building (10) comprises the steps of: forming the enclosure (22) by placing the air curtain (23) from the ceiling (11) down to a spaced distance of fifteen feet above the floor (12), and placing opposite ends (23'), (23") of the curtain (23) in contiguous relation with the respective adjacent wall portions (13'), (14'); installing the air duct (24) in a horizontal disposition about the full length of the air curtain (23), placing it laterally and inwardly of the curtain lower edge (27) relative to the enclosure (22); forming an air discharge slot (52) in the air duct (24) in a horizontally extended disposition facing inwardly of the enclosure (22); supplying outside air in an unconditioned condition to the air duct (24) and forcing the unconditioned air through the slot (52) into the enclosure (22) in a generally horizontal direction and at appropriate air flow velocity rates, i.e., cubic feet per minute (CFM's) and feet per minute (FPM) at appropriate static pressure levels; withdrawing air from outside the building (10), heating that air and forcing it into the enclosure (22); exhausting the air from within the enclosure (22) to the atmosphere; and controlling (33) the air supply, air withdrawal and heating, and air exhaust actions to provide the specified number of air changes per hour—ten in this instance, according to current standards of the American Conference of Governmental Industrial Hygienists.

An option can be added to the system, as illustrated best in FIG. 2, which uses low pick-up exhaust scoops (57) mounted over a machine such as a welding bench (21), for pulling contaminants completely away from the workers' breathing zone and exhausting them into the air curtain zone (59) where the exhaust fan unit (31) remove them from the building (10).

More specifically yet, the building (10) in the present instance is 300'×150' with the enclosure 280'×80'. The air duct (24) has an insulated liner within a thirty-six inch round pipe, with the discharge slot (52) having a three-inch high dimension. The heater units (28), (29) are Cambridge direct fired units rated at 850,000 BTU and 5,500 CFM and are placed normally within twenty feet of the air curtain (23), being capable of sweeping warm air up to 300' through a manufacturing area. The exhaust fan units (31) are rated at 28,000 CFM@0.125 SP, and the air supply fan units are rated at 14,933 CFM@0.50 SP, whereby to effect a discharge through the air duct slot (52) at 2500–3000 FPM.

Following is data comparing the instant clean air system under the trade name "Brockway" as installed at an industrial manufacturing area at Burlington, Iowa, with a standard make-up air and exhaust approach for the same manufacturing area. The installation costs were similar for both systems; but the difference in the operation costs of each system were dramatic.

(A) Physical and Engineering Data on the Manufacturing Area (Burlington, IA):
1. Plant description: Heavy Industrial Manufacturing
2. Square footage of manufacturing area: (300 feet × 150 feet) 45,000 FT2
3. Cubic footage for manufacturing area = 45,000 FT2 × 30 foot ceiling = 1,350.000 FT3
4. Type of area = Heavy Industrial Welding (automated and manual welding stations) and Production Assembly processes are both located in this manufacturing area.
5. Square footage of welding area: (280 feet × 80 feet) 22,400 FT2
6. Cubic footage for welding area: (22,400 FT2 × 30 foot ceiling = 672,000 FT3
7. Number of air changes per hour = 10 (Recommended by American Governmental Industrial Hygienists - 1992 Standards)
8. Iowa Southern Utilities 1992 average rate for industrial therms of natural gas = $0.43 per therm. A therm of natural gas is equal to 1.01 cubic feet of natural gas (CCF).

(B) Make-Up Air Requirements for Welding Area
1. CFM's required to have 10 air changes per hour in the welding area: (FT3/# of minutes per change = 672,000/6 = 112,000 CFM's
2. BTU's required for make-up air = 11,200.000 BTU's
3. Desired temperature in manufacturing area = 65 Degrees F.
4. Average temperature for heat degree days = 35 Degrees F.
5. Average number of heat degree days (Iowa Southern Utilities) = 151 days
6. Number of BTU's to raise ambient temperature 1 degree F. - .018 BTU's
7. Number of therms of natural gas to raise the inside temperature 30 degrees F. (35 to 65) for 151 days at 16 hours per day (2-eight hour Welding shifts) = 88.549 therms of natural gas (C) Operation Costs Per Year of Each Approach:
1. Standard Ventilation System:
   A. Make-up air requires 88,549 therms of natural gas/year
   B. Total natural gas operation cost = 88,549 therms × $0.43/therm = $38.076 per year
2. Brockway Clean Air System:
   A. Make-up air (80% recovery) requires 17,010 therms of natural gas/year
   B. Total natural gas operation cost = 17,010 therms × $0.43/therm = $7,314 per year
3. Difference of Operating Costs for the Two Approaches:
   A. Make-up air requirements = (88,549 − 17,010) = 71,539 therms/year
   B. Total natural gas operation cost = 71,539 therms × $0.43 therm = $30,762 per year There is an 81 percent difference in the operating costs of the two systems each year they are operated, such that users would receive tremendous benefits for a relatively small investment. The Brockway Clean Air System and the standard ventilation approach would normally cost $1000,000 to $115,000 to install for the above described heavy industrial welding manufacturing area (22,400 FT2).

(D) The Following is a Summary of Both Systems Return on Investment:

| | |
|---|---|
| 1. Standard Ventilation Approach: | |
| A. Installation Cost | $100,000 |
| B. Operation cost per year | 38,076 |
| C. 4-year operation cost | 152,304 |
| 2. Brockway Clean Air System: | |
| A. Installation Cost | $100,000 |
| B. Operation cost per year | 7,314 |
| C. 4-year operation cost | 29,256 |
| 3. Savings of The Brockway Clean Air System (Versus) Standard Approach: | |
| A. Installation of Systems - (No Dollar Savings) | |
| B. Annual operation cost of Systems - $30,762 in savings | |
| C. 4-year operation cost of Systems - $123,048 in savings | |

The Brockway Clean Air System, therefore, would normally have a complete payback of installation costs ($100,000) in the operation energy-savings of the system within the first four years of operation ($123,048).

(E) Chemical Exposure Levels of Selected Components in Welding Area:

| | |
|---|---|
| 1. OSHA's permissible exposure limit (PEL) for Industrial Welding Areas: | |
| A. Iron Oxide = | 10.00 MG/M3 |
| B. Copper Fume = | .10 MG/M3 |
| C. Manganese = | 1.00 MG/M3 |
| D. Total Weld Fume = | 5.00 MG/M3 |
| E. Total Particulates = | 15.00 MG/M3 |
| 2. Standard Ventilation Approach for Welding Area: | |
| A. Iron Oxide = | 8.67 MG/M3 |
| B. Copper Fume = | 0.08 MG/M3 |
| C. Manganese = | 0.82 MG/M3 |
| D. Total Weld Fume = | 9.57 MG/M3 |
| E. Total Particulates = | 9.91 MG/M3 |
| 3. Brockway Clean Air System for Welding Area: | |
| A. Iron Oxide = | 3.42 MG/M3 |
| B. Copper Fume = | 0.02 MG/M3 |
| C. Manganese = | 0.38 MG/M3 |
| D. Total Weld Fume = | 3.84 MG/M3 |

-continued

| | |
|---|---|
| E. Total Particulates = | 1.08 MG/M3 |

This shows there were significant differences in the exposure limits of each chemical component when the two systems are compared. The Brockway Clean Air System was on the average 72 percent below the acceptable OSHA Permissible Exposure Limits (PEL), while the standard ventilation system approach was only 6.8 percent on the average below the OSHA PEL's. The clean air system of this invention created an environment that is considered safe and within Permissible Exposure Limits (PEL) according to OSHA standards. However, the standard ventilation system did not meet OSHA PEL's in the Total Weld Fume category, but was within limits in the other four categories. Thus, the indoor air quality is significantly improved when a manufacturing facility utilizes the instant clean air instead of the standard ventilation approach.

It can therefore be seen that all of the aforementioned objectives have been met, the instant system combining the mechanical blow through systems with air curtains, hoods and Cambridge direct-fired heaters to provide an innovative clean air system that recovers a minimum of 80% of its own make-up air, while properly ventilating an industrial manufacturing area.

We claim:

1. In a building having a ceiling, a floor and a plurality of angularly related walls joining the floor and ceiling to form a room, an air cleaning system for the room comprising:

curtain means depending from the ceiling and having a lower edge spaced above the floor, said curtain means forming an enclosure within the room except for the open space between the floor and said lower edge;

air supply means for withdrawing air from external the building for subsequent transmission of the exterior air into said enclosure at a height generally equal the height of said curtain means lower edge;

air heating means for withdrawing air from external the building, for heating the external air and for transmission of said external, heated air into said enclosure;

air exhaust means for withdrawing air from within said enclosure and forcing it to outside the building; and control means for controlling the operation of said air supply means, air heating means and air exhaust means to effect a predetermined number of air changes per unit of time within said enclosure.

2. The air cleaning system of claim 1, and further wherein said curtain means comprises a curtain having an upper edge secured to the ceiling, and opposite ends placed in a contiguous manner within the building to form said enclosure.

3. The air cleaning system of claim 1, and further wherein said curtain means comprises a metal curtain panel.

4. The air cleaning system of claim 3, and further wherein said curtain panel is impervious to air flow.

5. The air cleaning system of claim 1, and further wherein said air supply means includes one or more fans mounted on top of the ceiling for introducing unconditioned air into said enclosure.

6. The air cleaning system of claim 1, and further wherein said air supply means includes a horizontally disposed duct adjacent said lower edge, said duct having an air discharge slot formed therein for discharging unconditioned air into said enclosure.

7. The air cleaning system of claim 6, and further wherein said air discharge slot extends generally horizontally along said duct and faces inwardly of said enclosure.

8. The air cleaning system of claim 6, and further wherein said exterior air is forced through said slot in a generally horizontal direction.

9. The air cleaning system of claim 6, and further wherein said air discharge slot faces inwardly and upwardly of said enclosure whereby exterior air forced therethrough moves generally inwardly and upwardly of said enclosure.

10. The air cleaning system of claim 1, and further wherein said air heating means comprises one or more air heater units mounted on one of the walls and operable to direct heated air toward the floor for deflection into said enclosure.

11. The air cleaning system of claim 1, and further wherein said air exhaust means comprises one or more exhaust fans mounted on top of the ceiling and centrally of the enclosure.

12. The air cleaning system of claim 1, and further wherein said air supply means comprises one or more fans mounted on top of the ceiling, a vertically disposed air passageway fluid connected at an upper end to each fan, and a horizontally disposed air duct fluid connected at a lower end of said air passageway, said air duct having an air discharge slot formed therein and spaced above the floor.

13. The air cleaning system of claim 12, and further wherein said curtain means comprises a metal curtain panel having an upper edge secured contiguous to the ceiling.

14. The air cleaning system of claim 12, and further wherein said air heating means comprises one or more air heater units mounted on one of the walls and operable to direct heated air toward the floor for deflection into said enclosure and said air exhaust means comprises one or more exhaust fans mounted on top of the ceiling and centrally of the enclosure.

15. A method of cleaning air within a building having a ceiling, a floor, and a plurality of angularly related walls forming a room, the method comprising the steps of:

forming an enclosure within the building by placing a horizontally disposed air duct around the building in front of one or more walls and spaced between the ceiling and the floor, and by installing an air impervious curtain from the ceiling down to a spaced distance above the floor, and placing opposed ends of the curtain in contiguous relation with respective walls, the bottom edge of the curtain placed generally laterally of said air duct;

supplying air from exterior the building ceiling to the air duct;

forming an air discharge slot in said duct in a horizontally extended disposition facing inwardly of said enclosure, whereby said outside air is forced outwardly of said slot into said enclosure;

withdrawing air from outside of the building, heating the withdrawn air and forcing it into said building and to said enclosure;

exhausting air from said enclosure to outside the building; and controlling the air supply, air withdrawal and air exhaust and effecting a predetermined number of air changes within said enclosure per unit of time.

* * * * *